United States Patent [19]

Hatakeyama et al.

[11] Patent Number: 4,474,871

[45] Date of Patent: Oct. 2, 1984

[54] METHOD FOR PROCESSING PHOTOGRAPHIC MATERIAL

[75] Inventors: Akira Hatakeyama; Takashi Naoi; Sumitaka Tatsuta, all of Shizuoka, Japan

[73] Assignee: Fuji Photo Co., Ltd., Kanagawa, Japan

[21] Appl. No.: 461,429

[22] Filed: Jan. 27, 1983

[30] Foreign Application Priority Data

Jan. 27, 1982 [JP] Japan ..... 57-11174

[51] Int. Cl.[3] ..... G03C 5/24

[52] U.S. Cl. ..... 430/423; 430/421

[58] Field of Search ..... 430/423, 421

[56] References Cited

U.S. PATENT DOCUMENTS

| | | | |
|---|---|---|---|
| 1,973,466 | 9/1934 | Crabtree | 430/423 |
| 3,649,281 | 3/1972 | Iwano et al. | 430/423 |
| 3,653,904 | 4/1972 | Friedel | 430/423 |
| 3,869,288 | 3/1975 | Godowsky | 430/405 |
| 4,172,723 | 10/1979 | Degenkolb | 430/423 |

OTHER PUBLICATIONS

Crabtree et al., "Some Properties of Two-Bath Developers for Motion Picture Film", JSMPE, vol. 21, 1933; pp. 21-53.

*Primary Examiner*—Mary F. Downey

*Attorney, Agent, or Firm*—Sughrue, Mion, Zinn, Macpeak, and Seas

[57] ABSTRACT

A method for processing a silver halide photographic material having at least one silver halide emulsion layer on at least one side of a support is disclosed. The method is characterized by pretreatment with a solution carried out prior to a development-processing. The solution being substantially unable to cause a development reaction though it contains a developing agent. The method improves the covering power of developed silver without deteriorating the physical properties of the silver halide photographic material.

15 Claims, No Drawings

METHOD FOR PROCESSING PHOTOGRAPHIC MATERIAL

FIELD OF THE INVENTION

This invention relates to an improved processing method for a silver halide photographic material, and more particularly, to a method for processing a silver halide photographic material which enables elevation of covering power of developed silver in a wet state during development-processing (the covering power being defined as a ratio of optical density of developed silver to gram-weight thereof per one square meter) and at the time of drying, which does not decrease the covering power of developed silver attained in the wet state.

BACKGROUND OF THE INVENTION

In recent years, reducing the amount of silver to be coated in a silver halide photographic material has been an important subject from the standpoint of saving resources.

As a general rule, a silver halide photographic material containing a specific silver halide emulsion in a given amount per unit area shows some definite value of optical density or covering power of developed silver.

The optical density generally increases with an increase in the amount of silver coated per unit area of a silver halide photographic material, and decreases with a decrease therein. Accordingly, if the amount of silver to be coated per unit area of silver halide photographic material is intended to be reduced the technique developed must also prevent a decrease in optical density when the amount of silver coated per unit area of the silver halide photographic material is reduced. More specifically, the technique must raise the covering power of the developed silver.

These are a number of generally known methods which involve adding polysaccharides to silver halide emulsion layers, protective layers or interlayers of silver halide photographic materials with the intention of raising covering powers of the silver halide photographic materials. For example, such methods are disclosed in U.S. Pat. Nos. 3,762,924; 3,063,838; 3,137,575; 3,069,267; 3,085,010; 3,087,818; 3,152,906; 3,185,569 and 3,441,412: British Pat. Nos. 1,063,841; 1,105,478 and 1,126,798: German Pat. Nos. 1,211,939; 1,286,399; 1,293,579 and 2,525,591: and so on. Other known methods involve adding hydrophilic polymers to photosensitive silver halide emulsion layers, protective layers or interlayers of silver halide photographic materials with the same intention as described above. Examples of these methods are disclosed in U.S. Pat. Nos. 3,178,296; 3,165,412; 3,271,158; 3,312,554; 3,514,289; 3,393,083; 3,316,097; 3,597,215; 3,591,387; 3,058,826; 3,043,698; 3,408,199 and 4,030,929: and so on.

However, the addition of a substance as described above is not desirable because it deteriorates physical properties of the silver halide photographic material. For example, surfaces of the silver halide photographic material are liable to be scratched during development-processing, the hydrophilic polymer added or gelatin used as a binder eludes into processing solutions, or the transparency of the photographic material is lowered by receiving processings. However, such methods can raise the covering power of developed silver of the silver halide photographic material.

Techniques for surmounting the above-described with the polysaccharides, in which in addition to the polysaccharides, hydrophilic polymers are further added, are disclosed in British Pat. No. 976,221: U.S. Pat. Nos. 3,203,804 and 3,514,289: and so on. However, all these techniques are not enough to completely prevent the above-described deterioration of physical properties of silver halide photographic materials.

SUMMARY OF THE INVENTION

Therefore, an object of this invention is to provide a processing method of silver halide photographic materials which can increase the covering power of developed silver without being attended by deterioration of physical properties of the silver halide photographic materials.

The above-described object is attained by dipping silver halide photographic materials in at least one pretreatment bath prior to development-processing, with the pretreatment bath containing a developing agent, but being substantially unable to cause a developing reaction.

DETAILED DESCRIPTION OF THE INVENTION a pretreatment bath of this invention is a solution such that it contains at least one developing agent to be employed in a usual developing solution.

The developing agent is present in such an amount that it does not cause a developing reaction of a silver halide photographic material.

Indispensable conditions of the pretreatment solution of this invention are as follows:

(1) the solution contains a developing agent, and (2) even when a silver halide photographic material is dipped in the solution, no developing reaction is substantially caused therein.

Specific examples of the developing agent which can be contained in the above-described solution include dihydroxybenzenes such as hydroquinone, chlorohydroquinone, bromohydroquinone, isopropylhydroquinone, methylhydroquinone, 2,3-dichlorohydroquinone, 2,5-dimethylhydroquinone, t-butylhydroquinone, etc.; 3-pyrazolidones such as 1-phenyl-3-pyrazolidone, etc.; aminophenols such as N-methyl-p-aminophenol, etc.; and so on. Of these, hydroquinone is preferred.

These developing agents may be used independently, or in combination of two or more thereof as occasion demands.

A preferable concentration of such a developing agent in the pretreatment solution is 0.1 g/l to saturation at the temperature of the liquid, and particularly 5 g/l to 40 g/l at a liquid temperature of 30° C.

Measures can be taken to prevent a developing reaction of a silver halide photographic material from being caused in the pretreatment solution containing a developing agent, such as a hydroquinones. For example, it is possible to add an appropriate acid such as acetic acid to the pretreatment solution to lower its pH to such a value that the developing reaction can not be caused therein (pH 7 or less).

The above-described expression "no developing reaction is substantially caused" means such a state that even when a sensitive material containing silver halide at a coverage of 12 g/cm$^2$ is dipped in a certain solution at 35° C. for 60 seconds, the sensitive material only obtains a maximum density of 0.2 or less.

In addition to a developing agent, the pretreatment solution of this invention may optionally contain a metal hydroxide such as sodium hydroxide, potassium hydroxide or the like; salts such as a carbonate (e.g., sodium carbonate, potassium carbonate, etc.), a phosphate (e.g., sodium primary phosphate, potassium tertiary phosphate, etc.), a borate (e.g., sodium metaborate, borax, etc.) or other buffering agents; a development inhibitor such as bromides, iodides, polyalkylene oxides or the like; an antioxidant such as sodium sulfite, potassium metabisulfite or the like; an acid like acetic acid; an organic solvent such as diethylene glycol, diethanolamine, triethanolamine or so on; a water softner such as sodium tetrapolyphosphate, sodium hexametaphosphate, sodium nitrilotriacetate, ethylenediamine tetraacetic acid or its sodium salt, or so on; a hardener like glutaraldehyde; a viscosity imparting agent such as carboxymethylcellulose, hydroxyethylcellulose or the like; and further, a color toning agent, a surface active agent, a defoaming agent and so on.

Also, commercially available developing solutions generally used for development-processing may be applied to the pretreatment solution, provided that they are modified so that they do not cause a developing reaction.

The pretreatment can be carried out at an arbitrary time during its period from after exposure to before development, preferably from 0.1 second to 100 minutes before the beginning of development-processing, and more preferably from 0.1 second to 60 seconds before the beginning of development-processing.

The pretreatment may be carried out at any temperature, provided that it is higher than 0° C., preferably higher than 10° C., and more preferably within the range of 30° C. to 40° C.

Dipping time in the pretreatment solution suitably ranges from 0.1 second to 100 minutes, preferably from 1 second to 15 minutes, and more preferably from 2 seconds to 3 minutes.

Examples of development-processing applicable to this invention may include the so-called dish development-processing, or processing using an automatic developing machine in the case of X-ray films and the like.

An automatic developing machine may be the type of machine in which films are conveyed by rollers, or the type of machine in which films are conveyed by belt.

Developing solutions generally used in silver halide photography can be used in connection with the present invention such as aqueous solutions containing one or more developing agents. Specific examples of such agents include a dihydroxybenzene derivative such as hydroquinone or catechol, an ascorbic acid derivative, a 3-pyrazolidone derivative such as 1-phenyl-3-pyrazolidone or 4,4-dimethyl-1-phenyl-3-pyrazolidone, an aminophenol derivative such as N-methyl-p-aminophenol or N,N-diethyl-p-aminophenol, a p-phenylenediamine derivative such as N,N-diethyl-p-phenylenediamine, N-ethyl-N-hydroxyethyl-p-phenylenediamine, 2-amino-5-diethylaminotoluene or N,N,N',N'-tetramethyl-p-phenylenediamine with hydroquinone being preferred. These agents can be used in combination with an antioxidant such as sodium sulfite or ascorbic acid, a salt like sodium sulfate, a pH controlling agent or a buffer such as boric acid, borax, sodium hydroxide, sodium carbonate or sodium tertiary phosphate, a development restrainer such as potassium bromide or potassium iodide, an organic antifoggant such as 6-nitrobenzimidazole or benzotriazole.

Developing solutions containing aldehydes, such as formaldehyde and gurtaraldehyde, in addition to or in combination with the above-described agents can also be employed.

Suitable development temperatures generally range from 10° C. to 60° C., and a suitable development time is within the range of 10 seconds to 30 minutes.

Example of fixing solutions usable in this invention include those having generally used compositions.

Suitable examples of the fixing agents contained in such compositions include not only thiosulfates and thiocyanates, but also organic sulfur compounds which have been known to have fixing effects.

Fixing solutions which can be used in this invention may contain water soluble aluminium salts as a hardener.

Suitable fixation temperatures generally range from 10° C. to 60° C., and a suitable fixation time from 10 seconds to 30 minutes.

The processing method of this invention can be applied to general black-and-white photographic materials.

Suitable examples of supports which can be employed in photographic materials of this invention include a cellulose nitrate film, a cellulose acetate film, a cellulose acetate butyrate film, a cellulose acetate propionate film, a polystyrene film, a polyethylene terephthalate film, a polycarbonate film, laminates of two or more thereof, paper (with specific examples including baryta paper, α-olefin polymer (especially polyethylene or polypropylene)-coated or -laminated paper, and the like) and so on.

Silver halide emulsions to be contained in silver halide photographic materials which can be employed in this invention are usually prepared by mixing water soluble silver salts (e.g., silver nitrate) with water soluble halides (e.g., potassium bromide) in the presence of solutions of water soluble macromolecular compounds like gelatin. Silver halides which are preferably contained therein include silver chloride, silver bromide, and mixed silver halides (specifically silver chlorobromide, silver iodobromide and silver chloroiodobromide). Grains of these silver halides are formed using known, conventional methods. Of course, the so-called single jet method, double jet method, controlled double jet method and the like are also used to advantage in forming such silver halide grains.

These photographic emulsions can be produced by the generally used ammonia process, neutral process, acid process and the like which are described in books such as in T. H. James & E. K. Mees, *The Theory of the Photographic Process*, 3rd. Ed., Macmillan, New York (1966); P. Glafkides, *Chemie Photographique*, Paul Montel, Paris (1957); and so on.

Silver halide emulsions are generally subjected to chemical sensitization, though chemically unsensitized (the so-called primitive) emulsions can be also employed. Chemical sensitization techniques which can be used for silver halide emulsions of this invention include those which are described in P. Glafkides, supra; the book written by Zelikman, et al.; and H. Friser, *Die Grundlagen der Photographischen Prozesse mit Silberhalogeniden*, Akademische Verlagsgesellschaft (1968).

More specifically, it is possible to use sulfur sensitization techniques using compounds containing sulfur reactive with silver ions and active gelatin, reduction sensitization techniques using reductive compounds, and nobel metal sensitization techniques using gold or other noble metal compounds. These techniques can be used individually or in combination thereof. Examples of useful sulfur sensitizers include thiosulfates, thioureas, thiazoles, rhodanines and other compounds, specific examples of which are described in U.S. Pat. Nos. 1,574,944; 2,410,689; 2,278,947; 2,728,668; 3,656,955; 4,032,928 and 4,067,740. Examples of reduction sensitizers include stannous salts, amines, hydrazine derivatives, formamidinesulfinic acid and silane compounds, specific examples of which are described in U.S. Pat. Nos. 2,487,850; 2,419,974; 2,518,698; 2,983,609; 2,983,610; 2,694,637; 3,930,867 and 4,054,458. Examples of nobel metal sensitizers include not only gold complexes but also complexes of Group VIII metals such as platinum, palladium and iridium specific examples of which are described in U.S. Pat. Nos. 2,399,083 and 2,448,060: British Patent No. 618,061: and so on.

Silver halide photographic emulsions of this invention can contain a wide variety of compounds for preventing fogging or stabilizing photographic functions during production, storage or photographic processings. Namely, azoles such as benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (especially 1-phenyl-5-mercaptotetrazole) and the like; mercaptopyrimidines; mercaptotriazines; thioketo compounds like oxazolinethione; azaindenes such as triazaindenes, tetraazaindenes (especially 4-hydroxy substituted (1,3,3a, 7)-tetraazaindenes), pentaazaindenes and the like; benzenethiosulfonic acid, benzenesulfinic acid, benzenesulfonic acid amide and other many compounds known as antifoggants or stabilizers can be added. For example, those which are described in U.S. Pat. Nos. 3,954,474 and 3,982,947: and published examined Japanese Patent Application No. 28660/77 can be employed.

Besides the silver halide photographic emulsion layers, silver halide photographic materials of this invention may have interlayers, filter layers, surface protecting layers and backing layers as occasions demand.

The silver halide photographic emulsion layer, the interlayer, the filter layer, the surface protecting layer, the backing layer and so on can contain a hardener, an antistatic agent, a coating acid, a matting agent, a brightening agent, a spectral sensitizing dye, a dye, a color coupler and so on as occasion demands.

For details of the above-described additives *Research Disclosure,* vol. 176, pp. 22–31 (Dec. 1978) can be referred to.

Each of the photographic constituent layers in the photographic material of this invention contains gelatin as its advantageous binder. Of course, hydrophilic colloids other than gelatin can also be used as the binder.

Suitable examples of such hydrophilic colloids include proteins such as gelatin derivatives, graft polymers of macromolecules on gelatin, albumine, casein and the like; sugar derivatives such as cellulose derivatives (e.g., hydroxyethyl cellulose, carboxymethyl cellulose, cellulose sulfuric acid esters, etc.), sodium alginate, starch derivatives and so on; and various kinds of synthetic hydrophilic homo- or co-polymers such as polyvinyl alcohol, partial acetal of polyvinyl alcohol, poly-N-vinylpyrrolidone, polyacrylic acid, polymethacrylic acid, polyacrylamide, polyvinylimidazole, polyvinylpyrazole, and so on.

Useful gelatins include not only lime processed gelatin but also acid processed gelatin, oxygen processed gelatin as described in *Bull. Soc. Phot. Japan,* No. 16, p. 30 (1966), hydrolysis products of gelatin, and enzymatically decomposed products of gelatin.

Useful gelatin derivatives can be obtained by reacting gelatin with a wide variety of compounds such as acid halides, acid anhydrides, isocyanates, bromoacetic acid, alkane sultones, vinylsulfonamides, maleinamide compounds, polyalkylene oxides, and epoxy compounds.

This invention is effective for photographic materials containing gelatin hardeners in reduced amounts.

A specific example of a photographic material to which this invention is applied to particularly advantage is X-ray films.

This invention will now be illustrated in more detail by reference to the following examples. However, this invention should not be construed as being limited to the following examples.

EXAMPLE 1

A sample constructed laminating in sequence a protective layer, an emulsion layer, a polyethylene terephthalate film support, an emulsion layer and a protective layer was prepared using conventional coating and drying techniques. Compositions of these layers are described below.

| | |
|---|---|
| (Emulsion Layer) | |
| Binder: | 5 g/m$^2$ of gelatin |
| Silver Coated: | 7 g/m$^2$ |
| Silver Halide Composition: | 1.5 mol % of AgI + 98.5 mol % of AgBr |
| Hardener: | 0.4 g per 100 g gelatin of 2,4-dichloro-6-hydroxy-1,3,5-triazine sodium salt |
| Antifoggant: | 0.5 g per 100 g silver of 1-phenyl-5-mercaptotetrazole |
| (Protective Layer) | |
| Binder: | 1.2 g/m$^2$ of gelatin |
| Hardener: | 0.4 g per 100 g binder of 2-hydroxy-4,6-dichloro-s-triazine sodium salt |

A piece of this sample was exposed to a sensitometer (FN sensitometer) produced by Wakasa Kogaku, and development-processed using an automatic developing machine for X-ray films (X-ray film automatic developing machine RN produced by Fuji Photo Film Co., Ltd.). The developing solution used was RD-III (produced by Fuji Photo Film Co., Ltd.), development temperature 35° C. and development time 25 seconds. The thus processed piece was taken as the control.

Another piece of the sample was exposed in the same manner as in the control and then, subjected to the pretreatment of this invention. An aqueous solution containing 30 g/l of hydroquinone (≈pH 6) was used as the pretreatment solution. The temperature of the pretreatment solution was 35° C., and the pretreatment time was 60 seconds.

After the pretreatment, the resulting piece was development-processed in the same manner as in the control. The thus processed piece was named Sample $A_1$.

An optical maximum density (abbreviated as Dm hereinafter) of the control and that of Sample $A_1$ were measured with a Macbeth densitometer.

In addition, the amount of developed silver in the control and that in Sample $A_1$ were measured using the fluorescent X-ray method (a fluorescent X-ray analyser for silver's exclusive use, made by Rigaku Denki).

The silver halide photographic material which had received the pretreatment of this invention was examined for susceptibility of being scratched on its surface in the developing solution by carrying out the following experiment.

The sample was dipped in the developing solution at 35° C. (the same solution as used for development of the above-described sample pieces) for 25 seconds, and a stylus having a sapphire ball measuring 0.4 mm in radius fitted up on its point was pressed on the sample surface and moved parallel with the sample surface as a load applied to the stylus was continuously altered from 0 to 200 g.

The load under which the scratch inflicted on the surface of the sample reached the support of the sample was measured. The thus obtained value was employed as a criterion for film strength.

Both the film strength of the sample which had not received the pretreatment (control) and that of the sample which had received the pretreatment (Sample $A_1$) were determined in the above-described manner.

Results of a series of experiments described above are summarized in Table-1.

TABLE 1

| Sample | Dm | Amount of Developed Silver (g/m²) | Covering power of Developed Silver | Film Strength (g) |
|---|---|---|---|---|
| Control | 3.4 | 6.9 | 0.49 | 86 |
| Sample $A_1$ | 4.0 | 6.8 | 0.59 | 87 |

As can be seen from Table 1, the pretreatment of this invention improved the covering power of developed silver without causing deterioration of physical properties of the silver halide photographic material.

EXAMPLE 2

A sample was prepared in the same manner as in Example 1.

A piece of this sample was exposed to light in the same manner as in Example 1 and then, development-processed using an automatic developing machine for X-ray films using RP-Developer (produced by Eastman Kodak Co.) as a developing solution. The development temperature was 35° C., and the development time was 25 seconds.

The thus processed piece was taken as the control.

Another piece of the sample was exposed to light in the same manner as in the control and subsequently, subjected to the pretreatment of this invention. A pretreatment solution, RP-Developer whose pH was adjusted to 7 by adding acetic acid thereto was employed.

The temperature of the pretreatment solution was 35° C., and the pretreatment time was 60 seconds.

After the pretreatment, the resulting piece was development-processed in the same manner as in the control. The thus processed piece was named Sample $A_2$.

Dm, an amount of developed silver, and film strength of the control and those of Sample $A_2$ were determined by the same methods as in Example 1.

Results of a series of experiments are shown in Table 2.

TABLE 2

| Sample | Dm | Amount of Developed Silver (g/m²) | Covering power of Developed Silver | Film Strength (g) |
|---|---|---|---|---|
| Control | 3.3 | 6.9 | 0.48 | 82 |
| Sample $A_2$ | 4 or above | 6.9 | 0.58 or above | 79 |

Table 2 shows that the pretreatment of this invention improved the covering power of developed silver without deteriorating the physical properties of the silver halide photographic material.

EXAMPLE 3

A sample was prepared in the same manner as in Example 1.

A piece of this sample was exposed to light in the same manner as in Example 1 and then, development-processed using the automatic developing machine for X-ray films (wherein XD-90 (produced by Konishiroku Photo Industry Co., Ltd.) was used as a developing solution, and the processing was carried out at 35° C. for 25 seconds). The thus processed piece was taken as the control.

Other pieces of this sample were exposed to light in the same manner as in the control and then, subjected to the pretreatments of this invention differing in treatment time, respectively. The pretreatment solution used was XD-90 whose pH was adjusted to 7 by adding acetic acid thereto.

The temperature of the pretreatment solution was 35° C., and pretreatment times ranging from 2 seconds to 200 minutes, as set forth in Table 3 hereinafter, were assigned to the sample pieces, respectively. After these pretreatments, each of the sample pieces was development-processed in the same manner as in the control. The thus processed sample pieces were named Samples $A_3$ to $E_3$, respectively.

The control and Samples $A_3$ to $E_3$ were each examined for Dm, the amount of developed silver and film strength using the same methods as in Example 1.

Results of a sereis of experiments are shown in Table 3.

TABLE 3

| Sample | Pre-treatment Time | Dm | Amount of Developed Silver (g/cm²) | Covering Power of Developed Silver | Film Strength (g) |
|---|---|---|---|---|---|
| Control | — | 3.3 | 6.9 | 0.48 | 88 |
| $A_3$ | 2 sec. | 4.0 | 7.0 | 0.57 | 91 |
| $B_3$ | 60 sec. | 4 or above | 6.9 | 0.58 or above | 90 |
| $C_3$ | 15 min. | 4 or above | 6.7 | 0.60 or above | 83 |
| $D_3$ | 100 min. | 4.0 | 6.5 | 0.62 | 71 |
| $E_3$ | 200 min. | 3.9 | 6.4 | 0.61 | 53 |

Table 3 shows that treatment times shorter than 100 minutes were suitable for the pretreatment of this invention.

EXAMPLE 4

Samples $A_4$ and $B_4$ were each constructed by laminating in sequence a protective layer, an emulsion layer, a polyethylene terephthalate film support, an emulsion layer and a protective layer. The samples were prepared using conventional coating and drying techniques. Compositions of these layers are described below:

| Emulsion Layer) | Binder: Gelatin (g/cm²) | Silver Coated (g/cm²) |
|---|---|---|
| Sample $A_4$ | 5.0 | 7.0 |
| Sample $B_4$ | 4.0 | 5.7 |

Silver Halide Composition: 1.5 mol % of AgI + 98.5 mol % of AgBr

-continued

| | |
|---|---|
| Hardener: | 0.4 g per 100 g gelatin of 2,4-dichloro-6-hydroxy-1,3,5-triazine sodium salt |
| Antifoggant: | 0.5 g per 100 g silver of 1-phenyl-5-mercaptotetrazole |
| (Protective Layer) | |
| Binder: | 1.2 g/m$^2$ of gelatin |
| Hardener: | 0.4 g per 100 g binder of 2-hydroxy-4,6-dichloro-s-triazine sodium salt |

Each of these samples was exposed to light in the same manner as in Example 1.

After exposure, Sample $A_4$ was development-processed using the automatic developing machine for X-ray films using RD-III as a developing solution. The development temperature was 35° C., and development time was 25 seconds. The thus processed sample was taken as the control.

On the other hand, optically exposed Sample $B_4$ was subjected to the pretreatment of this invention. The pretreatment solution used was RD-III whose pH was adjusted to 7 by adding acetic acid thereto. The temperature of the pretreatment solution was 35° C., and the pretreatment time was 60 seconds.

After the pretreatment, the resulting Sample $B_4$ was development-processed in the same manner as in Sample $A_4$.

The samples $A_4$ and $B_4$ were each examined for Dm, amount of developed silver and film strength using the same methods as in Example 1.

Results of a series of experiments are shown in Table 4.

TABLE 4

| Sample | Dm | Amount of Developed Silver (g/cm$^2$) | Covering Power of Developed Silver | Film Strength (g) |
|---|---|---|---|---|
| Sample $A_4$ | 3.3 | 6.9 | 0.48 | 83 |
| Sample $B_4$ | 3.8 | 5.7 | 0.67 | 79 |

As can be seen from Table-4, Sample $B_4$, which had received the pretreatment of this invention, exhibited higher Dm than Sample $A_4$, notwithstanding that Sample $B_4$ contain a smaller amount of coated silver.

Furthermore sample $B_4$ was not accompanied by deterioration of the physical properties of the film.

EXAMPLE 5

A sample was prepared in the same manner as in Example 1.

A piece of this sample was exposed to light in the same manner as in Example 1 and then, development-processed using the automatic developing machine for X-ray films, and RD-III was used as a developing solution. The processing was carried out at 35° C. for 25 seconds. The thus processed piece was taken as the control.

Other pieces of this samples were exposed to light in the same manner as in the control and subsequently, subjected to the pretreatments of this invention differing in treatment temperature, respectively. The pretreatment solution used was RD-III whose pH was adjusted to 7 by adding acetic acid thereto.

Temperatures of the pretreatment solution ranged from 10° C. to 50° C., and were assigned to the sample pieces as set forth in Table 5. The treatment time employed was 60 seconds in all the sample pieces.

After the pretreatments, these sample pieces were each development-processed in the same manner as in the control. The thus processed sample pieces were named Samples $A_5$ to $E_5$, respectively.

The control and Samples $A_5$ to $E_5$ were each examined for Dm, amount of developed silver and film strength using the same methods as in Example 1.

Results of a series of experiments are shown in Table 5.

TABLE 5

| Sample | Pretreatment Temperature | Dm | Amount of Developed Silver (g/cm$^2$) | Covering Power of Developed Silver | Film Strength (g) |
|---|---|---|---|---|---|
| Control | — | 3.5 | 6.9 | 0.51 | 79 |
| $A_5$ | 10° C. | 3.5 | 6.9 | 0.51 | 81 |
| $B_5$ | 20° C. | 3.5 | 6.8 | 0.51 | 76 |
| $C_5$ | 30° C. | 4.0 | 6.9 | 0.58 | 84 |
| $D_5$ | 40° C. | 4 or above | 6.8 | 0.59 or above | 71 |
| $E_5$ | 50° C. | 3.8 | 6.4 | 0.59 | 50 |

Table 5 shows that the pretreatment of this invention made it possible to increase the covering power of developed silver in the silver halide photographic material without deteriorating the physical properties.

The effect described above was particularly remarkable when temperatures of 30° C. or higher were employed as the pretreatment temperature.

However, when the pretreatment temperature was raised beyond 40° C. the strength of gelatin films employed as the binder was lowered. Therefore, the pretreatment temperatures determined as optimum were from 30° C. to 40° C.

EXAMPLE 6

A sample was prepared in the same manner as in Example 1.

A piece of this sample was exposed to light in the same manner as in Example 1 and subsequently, subjected to development processing by using the automatic developing machine for X-ray films and RD-III was used as the developing solution. The development was carried out at 35° C. for 25 seconds. The thus processed piece was taken as the control.

Other pieces of this samples were exposed to light in the same manner as in the control and subsequently, subjected to the pretreatment of this invention. The pretreatment solution used was RD-III whose pH was adjusted to 7 by adding acetic acid thereto. The temperature of the pretreatment solution was 35° C., and the pretreatment time was 60 seconds in all the sample pieces.

When 1 second to 180 minutes had passed after the conclusion of the pretreatment, the same development-processing as in the control was started.

The control and other sample pieces were each examined for Dm, amount of developed silver and film strength using the same methods as in Example 1.

Results of a series of experiments are shown in Table 6.

TABLE 6

| Sample | Time Interval between Pretreatment and Development | Dm (fog) | Amount of Developed Silver ($g/cm^2$) | Covering Power of Developed Silver | Film Strength (g) |
|---|---|---|---|---|---|
| Control | — | 3.3 (0.11) | 7.0 | 0.47 | 86 |
| $A_6$ | 1 sec. | 4 or above (0.11) | 6.9 | 0.58 or above | 91 |
| $B_6$ | 10 sec. | 4 or above (0.11) | 6.9 | 0.58 or above | 88 |
| $C_6$ | 1 min. | 4 or above (0.14) | 6.8 | 0.59 or above | 86 |
| $D_6$ | 10 min. | 4 or above (0.14) | 6.9 | 0.59 or above | 89 |
| $E_6$ | 60 min. | 4 or above (0.15) | 6.8 | 0.59 or above | 90 |
| $F_6$ | 180 min. | 4 or above (0.22) | 6.9 | 0.58 or above | 93 |

It can be seen from the above-described results that even if the pretreatment of this invention is carried out at any time before the development-processing, the covering power of the developed silver can be raised.

However, fog was somewhat increased as the time interval between the pretreatment and the development-processing increased.

Accordingly, the optimum time interval between the pretreatment and the developing-processing was found to range from 0.1 second to 1 minute.

While the invention has been described in detail and with reference to specific embodiments thereof, it will be apparent to one skilled in the art that various changes and modifications can be made therein without departing from the spirit and scope thereof.

What is claimed is:

1. A method for processing an exposed silver halide black-and-white photographic material comprised of a support having at least one silver halide emulsion layer on at least one side thereof, comprising the steps of:

dipping the exposed material in a pretreatment bath, said bath containing a developing agent which is a dihydroxybenzene having 2 —OH groups positioned at the para- positions to each other and not substantially causing any developing reaction in said pretreatment bath; and subjecting the material to development-processing with a developing agent after dipping in the bath, the development-processing being capable of causing a developing reaction to the extent that an image is formed on the material.

2. A method for processing an exposed silver halide photographic material as claimed in claim 1, wherein the developing agent is contained within the bath in a concentration of 0.1 g/l to saturation at the temperature of the liquid.

3. A method for processing an exposed silver halide photographic material as claimed in claim 2, wherein the developing agent is contained in the bath in a concentration of 5 g/l to 40 g/l.

4. A method for processing an exposed silver halide photographic material as claimed in claim 1, wherein the dipping is carried out during a period of time of from 0.1 second to 100 minutes before the development-processing.

5. A method for processing an exposed silver halide photographic material as claimed in claim 4, wherein the dipping is carried out within a period of time of from 0.1 second to 60 seconds before the development-processing.

6. A method for processing an exposed silver halide photographic material as claimed in claim 1, wherein the pretreatment bath has a temperature of from 10° C. to 40° C.

7. A method for processing an exposed silver halide photographic material as claimed in claim 6, wherein the bath has a temperature within the range of from 30° C. to 40° C.

8. A method for processing an exposed silver halide photographic material as claimed in claim 1, wherein the exposed material is dipped in the bath for a period of time of from 1 second to 15 minutes.

9. A method for processing an exposed silver halide photographic material as claimed in claim 8, wherein the exposed material is dipped in the bath for a period of time of from 2 seconds to 3 minutes.

10. A method for processing an exposed silver halide photographic material as claimed in claim 1, wherein the development-processing is carried out at a temperature of from 10° C. to 60° C. in a period of time of from 10 seconds to 30 minutes.

11. A method for processing an exposed silver halide photographic material as claimed in claim 1, wherein the bath produces a maximum density of 0.2 or less in an exposed silver halide photographic material containing silver halide at a coverage of 12 $g/cm^2$ when the material is dipped in the bath for 60 seconds at 35° C.

12. A method for processing an exposed silver halide photographic material as claimed in claim 11, wherein the developing agent contained within the bath is present in a concentration of 0.1 g/l to saturation at the temperature of the liquid, and the dipping is carried out during a period of time from 0.1 second to 100 minutes and at a temperature of from 10° C. to 40° C. before development-processing.

13. The method of claim 1 wherein the dihydroxybenzene is a hydroquinone selected from the group consisting of hydroquinone, chlorohydroquinone, bromohydroquinone, isopropylhydroquinone, methylhydroquinone, 2, 3-dichlorohydroquinone, 2,5-dimethylhydroquinone and t-butylhydroquinone.

14. The method of claim 13 wherein said development-processing is conducted with a developing agent selected from the group consisting of a dihydroxybenzene derivative, an absorbic acid derivative, a 3-pyrazolidone derivative, or an aminophenol derivative.

15. The method of claim 1 wherein said developing agent in said pretreatment bath is a hydroquinone and the pretreatment bath has a pH of 7 or less such that substantially no developing reaction is caused in said pretreatment bath.

* * * * *